United States Patent [19]

Cruzen et al.

[11] 4,095,925

[45] * Jun. 20, 1978

[54] CEMENTITIOUS PRODUCT MAKING SYSTEM WITH PRODUCT HEIGHT GAUGING MECHANISM

[75] Inventors: Harry F. Cruzen; Robert W. Gresham, both of Alpena, Mich.

[73] Assignee: Besser Company, Alpena, Mich.

[ * ] Notice: The portion of the term of this patent subsequent to Jun. 15, 1993, has been disclaimed.

[21] Appl. No.: 803,410

[22] Filed: Jun. 3, 1977

Related U.S. Application Data

[60] Continuation-in-part of Ser. No. 732,388, Nov. 14, 1976, Pat. No. 4,036,570, which is a continuation of Ser. No. 684,154, May 7, 1976, abandoned, which is a division of Ser. No. 475,757, Jun. 3, 1974, Pat. No. 3,963,397.

[51] Int. Cl.[2] ..... B28B 17/00; B28B 1/08

[52] U.S. Cl. ..... 425/141; 425/174.4

[58] Field of Search ..... 425/140, 141, 174.4

[56] References Cited

U.S. PATENT DOCUMENTS

| | | | |
|---|---|---|---|
| 3,122,784 | 3/1964 | Jolliffe | 425/141 |
| 3,819,775 | 6/1974 | Mules | 425/141 X |
| 3,963,397 | 6/1976 | Cruzen et al. | 425/141 |
| 4,036,570 | 7/1977 | Cruzen et al. | 425/140 X |

*Primary Examiner*—J. Howard Flint, Jr.

*Attorney, Agent, or Firm*—Learman & McCulloch

[57] ABSTRACT

An improved concrete product making machine having a product forming mold with a cavity for receiving cementitious material; support surfaces such as pallets on which the formed products are supported; a transfer device by which "green" products or blocks are removed on their pallets from the vicinity of the mold; a block height gauging device downstream of the mold, for gauging the height of the products by gauging the distance from the top surfaces of the pallets to the top surfaces of the products; and mechanism for indicating deviations from predetermined limits to enable corrections to be made and making them.

5 Claims, 7 Drawing Figures

30
60
46
48
68
31
76
70
58
56
54
44
66
74
90
69
29
88
78
86
80
82
84
50
52
40
42
38
18a
41
B
18
101
39a
39b
34
39
32
9
64
62
24
28
22
F

L1
L2
L3
L4
L5
L6
L7
L8
94
95
68
105
92
93
70
72
71
74
20
14
96
97
13
10
12
E
18
16
17
a
80
84
B
M
110
104
106
62a
62b

CEMENTITIOUS PRODUCT MAKING SYSTEM WITH PRODUCT HEIGHT GAUGING MECHANISM

BACKGROUND OF THE INVENTION

This application is a continuation-in-part of application Ser. No. 732,388, filed Nov. 14, 1976, now U.S. Pat. No. 4,036,570, which is a continuation of application Ser. No. 684,154, filed May 7, 1976, now abandoned, which application is a division of application Ser. No. 475,757, filed June 3, 1974, now U.S. Pat. No. 3,963,397, issued June 15, 1976.

In the manufacture of concrete building blocks, it is important for a variety of reasons that the blocks be uniform in size and density. In the subsequent laying of blocks, the height of the blocks becomes particularly important because the blocks must be laid in level courses.

In one block making machine which has been proposed, the heights of the blocks were gauged from the under surfaces of the pallets on which the blocks were supported. In such a machine, the thickness of the pallet affects the heights measured. For example, a block formed on a thick pallet will appear to have less height than a block formed on a thinner pallet. Accordingly, efforts were made to develop apparatus for gauging the height of the block independently of pallet thicknesses. One such machine includes apparatus for measuring the block height by gauging the distance from the top of the pallet while the mold is being vibrated. In this machine the vibration introduces another variable which affects the heights measured and negates some of the advantage resulting from gauging the block height independently of the pallet. Accordingly, it is an important concept of the present invention to provide improved block-engaging apparatus which gauges the heights of the blocks formed by measuring the distance from the top of each block supporting pallet to the tops of the blocks thereon at a time when the blocks are not being vibrated connected with apparatus for indicating that corrections need to be made and making them.

Other objects and advantages of the present invention will become apparent to those of ordinary skill in the art as the description thereof proceeds.

BRIEF SUMMARY OF THE INVENTION

A concrete product or block manufacturing machine with height gauging apparatus for gauging the height of a "green" block supported on a pallet by gauging the distance between the top of a block supporting pallet and the top of the product including: a frame; a support vertically movable on the frame between a raised, inoperative position and a lower, pallet top sensing position at a level dependent upon the level of the top of the pallet; a block top sensor mounted on the support for vertical movement relative thereto, to a level dependent upon the height of the formed block, and mechanism controlled by the sensing mechanism for indicating deviations from the norm to enable corrections to be made.

The present invention may more readily be understood by reference to the accompanying drawings in which.

Figure 3:
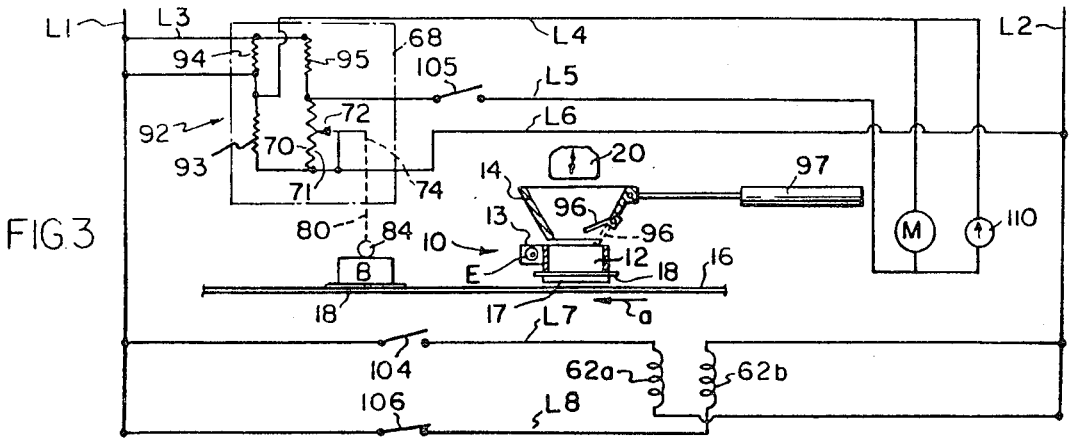
FIG. 3 is a schematic diagram illustrating a control circuit for controlling apparatus constructed according to the present invention.

Referring initially to FIG. 3, a block forming machine is schematically designated 10 and is of a construction more particularly illustrated in either of the present assignee's U.S. Pat. Nos. 2,957,222 or 3,679,340, which are incorporated herein by reference. A concrete block forming machine 10 includes a vibratile mold box 12, open at its upper and lower ends or sides and vibrated by an eccentric shaft device E. A pallet conveyor, generally designated 16, is provided for moving block supporting mold pallets 18 successively into a position at the under side of the mold box 12 as described more particularly in the referenced patents. Also provided is a vertically movable pallet support frame 17, situated between the belts of conveyor 16, to move the pallet 18 upwardly off the conveyor 16 into engagement with the underside of mold box 12. A cementitious material feed box 14 is slidably movable in a to-and-fro path between a remote or removed material receiving position and a material discharge position, over the mold box 12, in which it delivers cementitious material thereto.

As the feed box 14 is withdrawn, the mold box 12 is vibrated for a predetermined time via vibrating mechanism 13, to cause the cementitious material to settle and a stripper head, generally designated 20, is thereafter lowered into engagement with the vibrating material in the mold box 12 to pack the material into the mold cavity and form the block to its proper height. When the block is formed to the proper height, the vibration is interrupted and the stripper head 20 will continue to move the side-by-side blocks B (FIG. 1), downwardly toward the underlying pallet conveyor 16.

As the stripper head 20 is moved downwardly relative to the mold box 12 to strip the side-by-side blocks B from the mold box, the pallet frame 17 is concurrently moved downwardly to deposit the pallet 18 on the underlying conveyor 16. The conveyor 16, as indicated, includes a pair of laterally spaced apart belts 22, trained around end rolls 24, and supported along their length by idler rolls 26 journaled, via shafts 28, on a frame, generally designated F.

Block height gauging apparatus (FIG. 1), is provided at a block height sensing station 31, downstream of the block making machine 10, and includes a pair of gauging devices, generally designated 29, on opposite sides of the conveyor 16 between belts 22 for measuring or gauging the height of the side-by-side blocks B and indicating any deviation from a predetermined standard. The block height gauging apparatus 30 includes a pair of frame supported, vertically disposed, side bars 32 mounting longitudinally extending, horizontally disposed supports 34.

Mounted on each horizontally disposed support 34 is a horizontally disposed, double acting, solenoid actuated, fluid pressure operated cylinder 38 including an axially movable piston rod 39, having opposite end portions 39*a* and 39*b* extending axially beyond opposite ends of the cylinder 38. Mounted to span opposite ends of each piston rod 39 is a laterally movable, inverted, U-shaped mounting bracket 40. A coil spring 42 is disposed on the inner end 39*a* of the piston rod 39 and reacts between the cylinder 38 and the bracket 40 to bias the piston rod 39 inwardly to the laterally inner position illustrated at the left side of FIG. 1. Each piston rod is retractible to the position illustrated at the right side of FIG. 1.

Mounted on each bracket 40 for lateral movement therewith, is an upstanding channel 44 provided with internally disposed guides 46 guiding a vertically movable roller supporting rod 48. Mounted at the lower end of the guide rod 48 is a bracket 50, journaling a pallet engaging roller 52. Longitudinally convergent block centering rails 41 are fixed to the inverted, U-shaped mounting brackets 40 on opposite sides of the conveyor for centering the block supporting pallet 18 as it moves downstream in the direction of the arrow *a* (FIG. 2) to the block height sensing station 31.

Since the successive pallets 18 are not all exactly of the same thickness, it is important that the height of the blocks B be gauged from the top surface 18*a* of each pallet, and not the bottom thereof because deviations in the thickness of the pallets 18 will introduce error into the guaged height. For this reason, the pallet sensing rollers 52 engage the top surface 18*a* of each pallet 18. A guide bracket 54 is mounted on each upstanding channel 44 and includes a vertical guide opening 56 for receiving a guide pin 58 which is fixed to the vertically movable roller mounting rod 48. Also, a stop 60 is fixed to the top of each rod 48 for engaging guide 46 and limiting downward movement.

Figure 1:
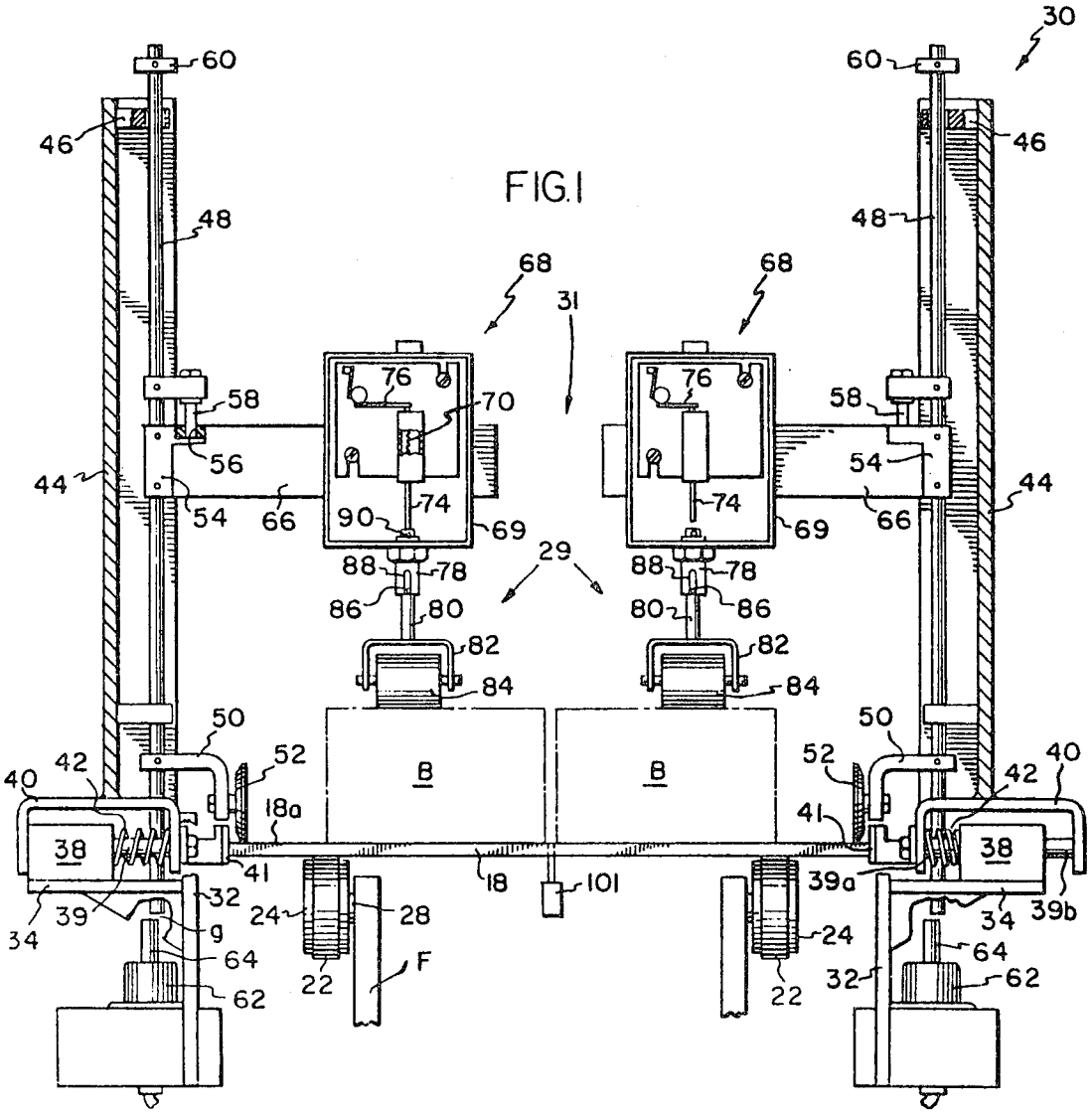
FIG. 1 is a sectional end view of apparatus constructed according to the present invention, taken along the line 1—1 of FIG. 2.

Apparatus is provided for moving the roller mounting rods 48 from the lowered positions, illustrated in FIG. 1, to raised positions, removed from the pallet 18, and comprises a pair of double acting, solenoid actuated, fluid pressure operated cylinders 62, mounted on the side rails 32 and including piston rods 64 having at least portions thereof axially aligned with the guide rods 48. A slight gap *g* is provided between the adjacent ends of the rods 64 and 48 when the cylinder rods 64 are retracted and the rollers 52 engage the top of a pallet.

Fixed to each roller mounting rod 48 at each side of the conveyor is a horiziontally supported, mounting bar 66 carrying sensing apparatus, generally designated 68, which is in the path of and engages the tops of the blocks B as they move in a forward path of travel represented by the arrow *a*. The sensing apparatus 68 includes a housing 69 above each block B mounting a variable resistance electrical device 70, such as a rheostat or potentiometer having a linear resistor 71 and a resistor engaging wiper arm 72 (FIG. 3), mounted on a vertically movable actuating rod 74 which may be normally biased downwardly by means such as a leaf spring 76. Mounted on the underside of each housing 69 is a vertical sleeve 78 receiving a roller mounting rod 80 having a clevis 82 fixed to its lower end to journal a block engaging roller 84. A guide pin 86, fixed to the rod 80, is received in a slot 88 on the sleeve 78 for guiding the rod 80 as it moves vertically. A stop pin 90 is fixed to the upper end of each rod 80 to engage housing 69 and maintain it in suspended position.

THE CONTROL CIRCUIT

Figure 2:
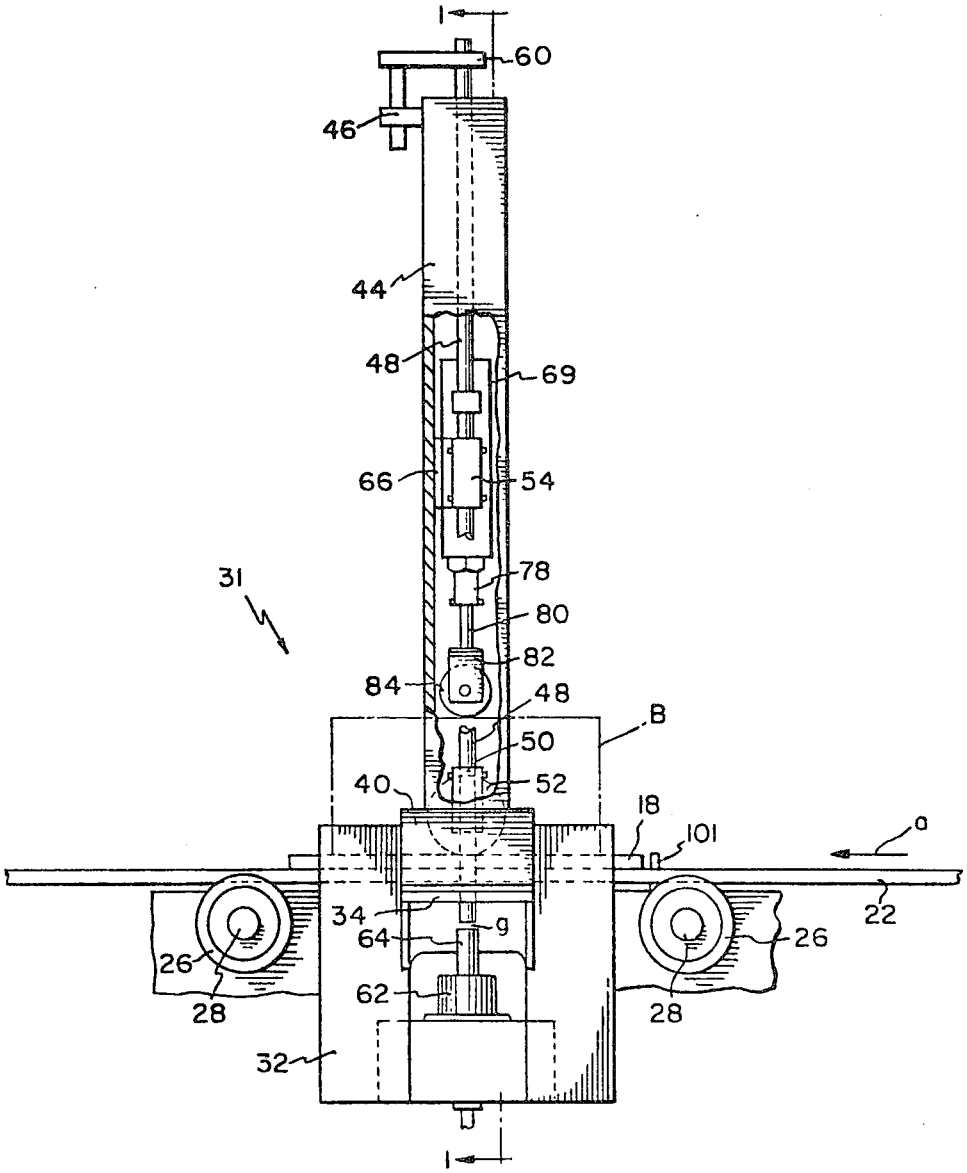
FIG. 2 is a partly sectional, side elevational view of the apparatus illustrated in FIG. 1.

A control system for controlling the apparatus illustrated in FIGS. 1 and 2 is illustrated in FIG. 3, and includes a pair of lines L1 and L2 connected across a suitable source of direct current electrical power. The resistor 70 of each block height gauging device 27 is connected in a typical bridge circuit, generally designated 92, including resistors 93, 94 and 95 connected as usual in bridge circuit relation across lines L3, L4, L5 and L6. The movable potentiometer arm 72, which is mechanically connected to the block engaging roller 84 via the rod 80 is also connected electrically to the line L5. More specifically, and as illustrated in FIG. 3, line L3 is connected between line L1 and the junction of the resistors 94 and 95; line L6 is connected between the line L1 and to the junction of the resistors 93 and 70. The opposite sides of a direct current motor M, for controlling the mount of material delivered to the mold box, are connected to lines L4 and L5 which are connected to the junction of the resistors 93 and 94, and to the junction of the resistors 70 and 95, respectively. The motor M, which pivots a discharge gate 96 between the solid and broken line positions shown in FIG. 3, is driven in opposite directions depending upon the condition of unbalance of the bridge circuit 92. The speed of the motor M is dependent upon the degree of unbalance. If the circuit 92 is balanced, the motor M is not driven. The unbalance is, of course, dependent upon the position of the wiper arm 72. The gate 96, which is connected to the motor M by suitable linkage (not shown), selectively tends to close the outlet portion of the hopper 14 and thus controls the amount of material fed to the mold 12. Provided to reciprocate the feed hopper 14 (and gate 96) is a double acting, fluid operated, solenoid controlled power cylinder 97 which, between each block forming operation, removes the hopper 14 to the right in FIG. 3, to a position under a material supply device (not shown) and then returns it to the mold feeding position in which it is shown in FIG. 3. Alternatively, or conjunctively, the motor M could be connected to a screw device mounting stripper 20 to adjust its position relative to the power cylinder or the like, which moves it, and thereby vary the vertical position which it assumes while the mold is being vibrated.

A proximity switch 101 (FIGS. 1 and 2) is provided in the path of the pallets 18 to indicate that a pallet is at the block height sensing station 31 and includes normally open contacts 104 (line L7), normally open contacts 105 (line L5) and normally closed contacts 106 (line L8). The contacts 104 (line L7) are connected in series with a solenoid 62*a* which directs fluid to each cylinder 62 to retract the piston rods 64 and permit the roller support rods 48 and the pallet engaging rollers 52 to lower to the block engaging position illustrated in FIG. 2. The switch 106 (line L8) is connected in series with a solenoid 62*b* which, when energized, will direct fluid to each cylinder 62 in such a direction as to raise its piston rod 64 and move the superjacent roller support rod 48 and roller 52 to a predetermined position above the level of the pallet surface 18*a* when no pallet is at the sensing station.

THE OPERATION

Cementitious material is supplied to the feed box 14, which is moved to a position over a mold 12 having a pallet 18 held against its underside by the pallet frame 17, to discharge the cementitious material into the mold 12. The feed supply box 14 is then withdrawn by cylinder 97 and the stripper head 20 is lowered to compact the material in the mold 12 while the mold 12 is being vibrated. The motor which drives eccentric E is, as usual, connected with a circuit line which includes a contact carried by the stripper head and a vertically aligned contact carried by the mold box. When the stripper head contact, due to compaction of the material, engages the mold box contact, the circuit to the motor driving eccentric E is broken. Thus, when the desired compaction occurs, (as gauged by the contacts engaging) mold box vibration is interrupted and the stripper head 20 continues to move downwardly to move the pallet 18 and pallet support frame 17 downwardly until the pallet 18 is supported by the conveyor 16 which forwardly conveys the blocks B downstream of the mold 12 in the direction represented by the arrow *a*, to the block height sensing station 31.

The piston rods 64 are normally extended to lift the roller supporting rods 48 and the rollers 52 to positions above the level of the pallet surface 18*a*. When the proximity switch 101 is tripped to indicate that a pallet is in position at the gauging station 31, the solenoids 62*a* are energized to lower the piston rods 64 so that the rods 48 and rollers 52 will lower into engagement with the top pallet surface 18*a*. If the blocks B are undersize, they will not move the rollers 84 upwardly. The wiper arms 72 will remain in their lowermost positions to unbalance the circuit in one direction and drive the motor M in such a direction as to pivot the blade 96 in a direction so that additional material will fall into the mold on the subsequent block formation cycle.

If the blocks B are of the proper predetermined height, they will force the rollers 84 and piston rods 80 upwardly to push the rods 74 and the wiper arm 72 upwardly to the position in which the circuit will remain balanced and the motor M will not be driven. A switch 105, provided in line L4, is only closed when the switch 101 is actuated so that the motor M is not driven when blocks B are not in position at the gauging station 31. If blocks B are oversize, the rollers 84 will move the slider 72 to the top of resistor 70 to unbalance the bridge circuits 92 in the opposite direction and drive the motor M in the opposite direction to tend to close the gate 96 and permit less cementitious material to flow into the mold 12 on the subsequent block forming cycle. A galvanometer 110 is connected in parallel with the motor M to provide a visual indication to the operator of the degree of deviation of the height of the block B from a predetermined height. The apparatus is, as described, self-correcting to correct any deviation in the height of the blocks being formed.

Figure 7:
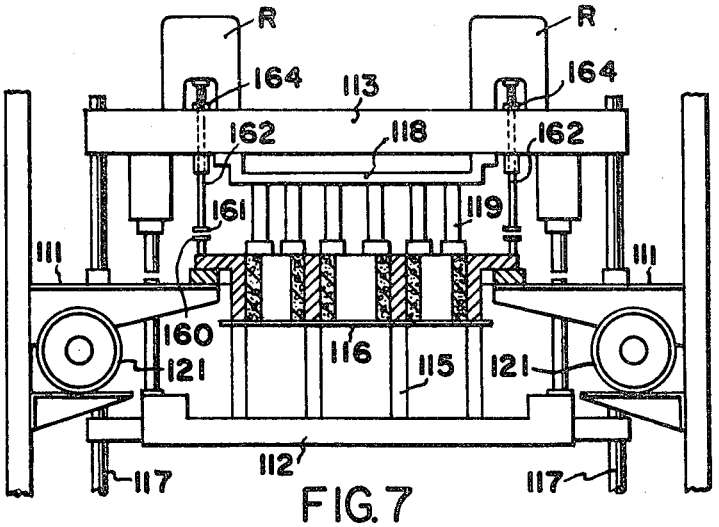
FIG. 7 is a schematic side elevational view of certain elements of the modified machine.

In an alternative embodiment of the invention it will be assumed that a system of the type disclosed in Wellnitz U.S. Pat. No. 2,985,935, wherein block height is controlled with contact posts on the stripper head frame which, when engaged make a circuit to stop the vibration of the mold, is utilized. FIG. 7 schematically depicts such a system wherein the main elements of a concrete block forming machine include a mold block supporting frame 111, a pallet carrying frame 112, and a pressure head or stripper head supporting frame 113. A mold box 114 is carried by the frame 111 which is fixed in vertical position. As usual the mold box 114 is open at its upper and lower ends.

The pallet frame 112 carries the upstanding laterally spaced pallet support posts 115 which receives and supports a pallet 116 directly below the open end of mold box 114. Pallet frame 112 is mounted for vertical movement on guide posts 117 fixed to frame 111.

The stripper frame 113 includes a head 118 with dependent block strippers 119 which engage the cementitious material during the molding operation. The stripper frame 113 is also mounted for vertical movement on a suitable guide structure such as the posts 117, and it should be plain that pallet frame 112 and stripper head 113 are movable vertically relative to each other. The mold box supporting frame 111 carries, at each side thereof, a mold box vibrating unit 120 which includes an electric vibrating motor M-1 and eccentrics E (as shown in FIG. 3) for vibrating the frame 111 and the mold box 114 which it supports. A suitable conveyor system not shown is provided for successively bringing empty pallets into association with the pallet frame 112 preparatory to the molding operation and for removing the block carrying pallets therefrom after the molding operation.

The machine also includes a feed box (such as at 14 in FIG. 3) which may be of the character previously described, mounted for forward and rearward movement on the frame 111, from a removed position, in which it will receive a charge of block forming material from a feed hopper to a position in registry with the mold box 114 for supplying material thereto as previously described. This occurs at a time when stripper head 118 is in raised position. The feed box utilized may not include the adjustable gate 96 shown in FIG. 3 and instead a system for controlling the length of time of vibration of mold 14 may be utilized. This system may take the form of rods or screws 162 mounted on the stripper head 113 via nuts 164, the rods 162 being coupled to the armature shafts of reversible electric motors R which are capable of adjusting their vertical position relative to stripper head 13. The rods 162 have contact discs or surfaces 161, adapted to be engaged by contact discs or surfaces 160 supported in fixed position on the mold box 114. The operation of this type of system is well described in the Wellnitz patent mentioned which is incorporated herein by reference and no further description of its operation is deemed necessary.

Figure 4:
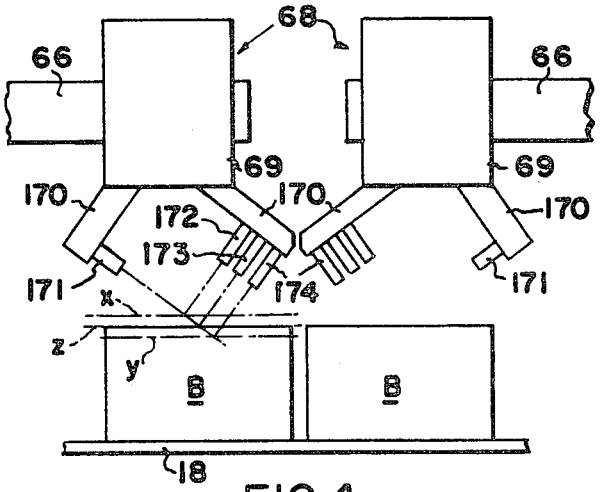
FIG. 4 is a fragmentary schematic diagram, illustrating a modified form of apparatus in which the upper sensors for sensing the level of the upper surfaces of the block being produced need not be mounted in physical contact with the block to move up and down in accordance with variations in block height.

Referring now more particularly to FIG. 4, the sensing apparatus 68 which is mounted on bars 66 in this embodiment of the invention takes a different form than rollers 84. Here support arms 170 are fixed to each electrical circuitry box 69, which in turn is fixed to each support arm 66. Although it is to be understood that the support arms 170 are mounted on both sides of the machine, since in the embodiment illustrated side-by-side blocks B are being engaged simultaneously, only one such installation for gauging a single block B will be described since the other is identical.

Provided on one of the arms 170 is a light source 171 for issuing a beam of light 172 to impinge upon the top surface of the block B at about the center thereof. On the opposite confronting support arm 170 are three detectors 172, 173 and 174 which may be termed respectively the "too high" detector, the "correct height" detector and the "too low" detector. Each of the detectors 172–174 is of the type which senses the distance between itself and the point of light impingement upon the upper surface of the block B. Such light sources and optics detectors with accompanying circuitry, are commercially available, the Model 202 system, manufactured by Opcon, Incorporated of Everett, Wash., U.S.A. may be utilized. The detectors are set to sense the wave distance between the point of light impingement and the position in which they are mounted on arm 170, and, if this distance varies from the preset or normal condition, function to energize contacts in an electrical circuit. In FIG. 4, the line *x* represents the surface of a block which is of greater height than desired, the surface *y* represents the upper surface of a block which is of insufficient height, and the surface *z* represents a block which is of the desired height.

Figure 5:
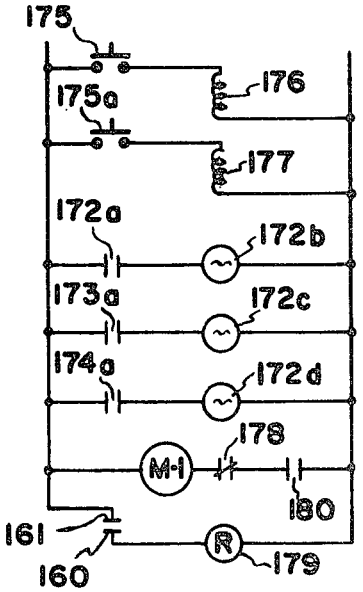
FIG. 5 is a schematic diagram illustrating a control circuit which is operable for indicating that corrections need to be made for the FIG. 4 system.
Figure 6:
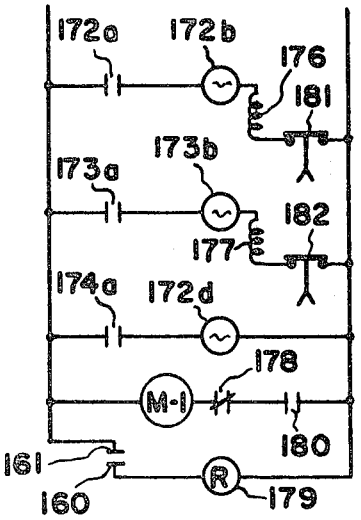
FIG. 6 is a similar schematic circuit illustrating automatic correction.

In FIGS. 5 and 6, schematic manually correcting and automatically correcting circuits respectively are illustrated. In FIG. 5, the contacts 172*a*, 173*a*, and 174*a* are those for detectors 172, 173, and 174 respectively which, when closed, energize signal lights 172*b*, 172*c*, and 172*d* respectively. Push-button 175 is provided in circuit with the coil 176 of each motor R to rotate the screws 162 in a direction to lower the contact surfaces 161 on the lower ends thereof. Similarly push-button 175*a* is located in circuit with the reversing coils 177 of motors R to rotate them in a direction to raise the screws 162. If it is indicated that the block height is correct, the contacts 173*a* will remain closed and the light 172*c* will remain lit, indicating that the machine is operating satisfactorily to provide blocks of the desired height. However, if contacts 172*a* are made and light 172*b* is lit, indicating that the blocks are of greater height than desired, the operator simply presses button 175 to lower the screws 162 slightly before head 113 is lowered. Thus the contacts 161 and 160 will come into contact sooner than previously and the vibration caused by motor M vibrating mold box 114 comes to an end sooner. If the contacts 173*a* are made and light 172*c* is lit, the operator simply presses button 175*a* to raise the screws 162 so that a longer vibration time is provided.

The motors M-1, as shown in FIG. 5, are in circuit with a set of contacts 178 controlled by the relay 179 so as to break the motor circuit and stop the vibration at a predesignated time in the molding cycle. The contacts 180 are those which start the vibrating motors M-1 after a charge of material has been delivered to the upper end of the mold by a feed-box such as indicated at 14 in FIG. 3, and may comprise a limit switch which is closed by the feed-box.

FIG. 6 shows a similar circuit which operates automatically and does not require push-buttons. In this circuit the block height contacts 172*a* are in series with the signal light 172*b* and the coil 176. A time delay switch 181 is also provided in the circuit and is set to open a predetermined interval after being energized. This automatically resetting time delay 181 is preset to determine the increment of time each motor R coil 176 is energized to provide a predetermined incremental lowering of the screws 162. A similar time delay switch 182 is provided in circuit with the "block low" contacts 173*a* and "block low" signal light 173*b*. Otherwise, of course, the operation of the circuit is identical.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

We claim:

1. In an improved cementitious product making system having a frame means; a product forming mold mounted thereon at a mold station and having a mold cavity for receiving cementitious material; mechanism mounted by the frame means operably connected to supply material to the mold and to pack material in the mold when cementitious material is supplied thereto, to aid in formation of a product in the mold cavity; product receiving means carried by the frame system for receiving a newly formed product made in the mold and comprising a transfer means and a support pallet surface upon which the product is carried for downstream movement from the molding station; means on the frame system for relatively moving the mold and at least a portion of the product receiving means to release the product from the mold and including a stripper head; the improvement comprising: gauging carrier means; means, supporting the gauging carrier means at a gauging station, for vertical movements toward and away from the product receiving means from a raised non-gauging position to a lowered gauging position; upper and lower sensor devices carried thereby, the lower sensor device being mounted vertically at a location to locate on the upper level of the support surface, the upper sensor device being supported at a laterally inboard location to sense the level of the upper surface of the product; means for moving said carrier means vertically away from lowered gauging position; means for sensing the presence of a product receiving means and a newly molded product at said gauging station and controlling the carrier means to permit its movement down to gauging position; and a control circuit mechanism connected to the upper sensor device to respond to variations from a predetermined norm, including means for controlling said mechanism to correct the condition.

2. The system defined in claim 1 in which said upper sensor device comprises a wave emitting source mounted to play upon the upper surface of the block, and detector means associated therewith to indicate whether the point of impingement on the block is above or below a predesignated level.

3. The system defined in claim 2 in which said source is an electromagnetic light wave energy source in the infrared spectrum which is modulated to provide wave length contorl and said detectors receive or do not receive the reflected beam according to whether they are in position to receive the reflected light at the angle of reflection.

4. The system defined in claim 1 in which said mechanism includes means for vibrating said mold to pack material therein once the material is supplied thereto and said means for controlling said mechanism includes elements for varying the time of vibration to control the "green" block height.

5. The system defined in claim 4 in which said vibration means includes an electric motor, a pair of contact members are carried by the mold and stripper head so as to be in predetermined spaced relation when the stripper head and mold are in a relative position in which stripping of the block from the mold is not taking place; means connected with the motor in a circuit to halt said motor when the contacts are brought into engagement; and said means for controlling said mechanism includes motor means for varying the relative spacing of said contacts prior to the time they are brought into engagement.

* * * * *